United States Patent [19]

Hade

[11] 4,272,199

[45] Jun. 9, 1981

[54] MIXING CONTAINER

[76] Inventor: Horace A. Hade, 6303 Valley Dr., R.R. #2, Grabill, Ind. 46741

[21] Appl. No.: 662,144

[22] Filed: Feb. 27, 1976

[51] Int. Cl.[3] ..... B01F 7/00

[52] U.S. Cl. ..... 366/130; 206/222; 366/196; 366/333

[58] Field of Search ..... 259/7, 8, 28, 29, 36, 259/37, 39, 40, 42, 43, 44, 47, 48, 61–67, 70, 71, 101, 107, 108, 111, 113, 114; 206/219, 222; 222/94; 366/130, 196, 332, 333

[56] References Cited

U.S. PATENT DOCUMENTS

| | | | |
|---|---|---|---|
| 1,836,026 | 12/1931 | Helle | 259/47 |
| 3,043,424 | 7/1962 | Howard | 206/219 X |
| 3,140,078 | 7/1964 | Krahe et al. | 259/47 |
| 3,144,966 | 8/1964 | Cook | 259/47 X |
| 3,153,531 | 10/1964 | Cook | 259/47 X |
| 3,188,056 | 6/1965 | Trumbull et al. | 259/47 X |

*Primary Examiner*—Philip R. Coe

*Attorney, Agent, or Firm*—Lundy and Associates

[57] ABSTRACT

A mixing container in which two or more completely incompatible materials may be packaged, stored, and prior to use mixed together. The mixing container comprises an exterior container and one or more interior containers. The largest volume material of those being stored is placed within the exterior container. The other incompatible materials are placed within the interior containers, respectively. A shaft extends into the exterior container. Affixed to the inner end of the shaft is a rotor. The shaft and the rotor can both rotate and move axially of the shaft. Each of the interior containers are breakable and may be broken by contact with the rotor. The rotor is also capable of completely mixing the contents of each of the containers whereby various incompatible materials may be completely and homogeneously mixed prior to use. The exterior container of the invention may be modified with a nozzle and means for dispensing the mixture through the nozzle.

6 Claims, 4 Drawing Figures

MIXING CONTAINER

BACKGROUND OF THE INVENTION

1. Field of the Invention

The present invention relates to containers capable of storing two or more incompatible materials for long periods of time, and more specifically to a container capable of both storing and mixing, prior to use, two or more incompatible components of a mixture within the container itself.

2. Description of the Prior Art

Containers such as buckets have long been used for the storage and shipping of both powders and liquids, and various stirring devices such as propeller devices have long been used to stir mixtures, such as paints and the like. The prior art has taught that incompatible materials, such as the polyol and isocyanate materials of a polyurethane resin, must be shipped in separate containers and mixed prior to use. Although the shipping and mixing of such materials may be accomplished by using apparatus and methods taught by prior art, the dangers of spillage and contamination are present, and the problems of obtaining a mixture of the right proportions and the inconvenience of using separately packaged materials are very real. Therefore, it would be desirable to provide an improved shipping container for two or more incompa-materials designed in a manner such that the materials may be mixed in the container without opening the container and used from the container.

SUMMARY OF THE INVENTION

It is therefore an object of the invention to provide an improved package or shipping container for incompatible materials which are to be used together.

It is another object of this invention to provide an improved dispenser of mixtures having two or more incompatible components, the dispenser having self-contained means for mixing the components together in the dispenser prior to use.

It is another object of the invention to provide an improved container for mixtures having two or more incompatible components, the container having self-contained means for mixing the components together within the container prior to use.

It is further an object of the invention to provide an improved package or shipping container for incompatible components of a mixture, either in powdered or liquid form, the package or shipping container having self-contained means for dispensing the mixture therefrom and/or mixing the components therein prior to use.

In the broader aspects of the invention there is provided a container in which two or more completely incompatible materials may be packaged, stored, and prior to use mixed together. The largest volume material is placed in an exterior container; the other materials are placed in containers within the exterior container. Means is provided within the exterior container for both breaking the interior containers and mixing the materials within the exterior container. Means may also be provided for dispensing the mixture from the container.

BRIEF DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings, wherein.

DESCRIPTION OF THE PREFERRED EMBODIMENT

Figure 1:
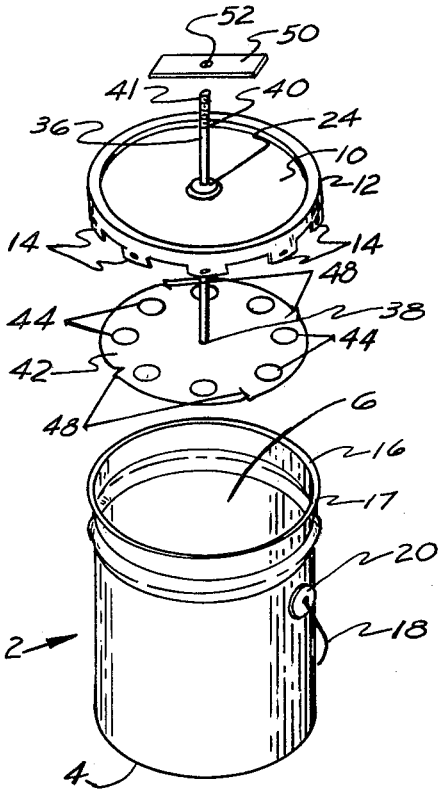
FIG. 1 is a perspective and exploded view of the improved container of the invention, especially useful for gallon quantities and larger.
Figure 2:
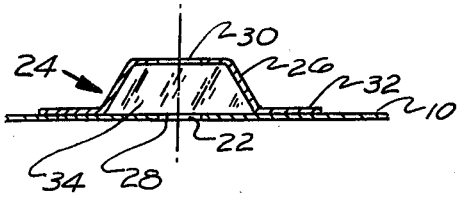
FIG. 2 is an enlarged, perspective and fragmentary view of the shaft seal of the container shown in FIG. 1.
Figure 4:
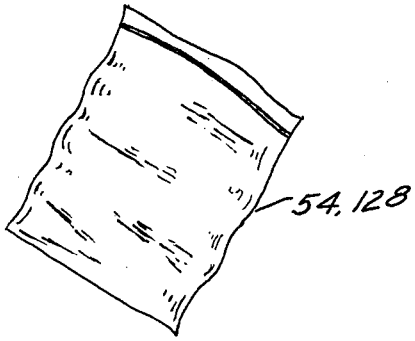
FIG. 4 is a perspective view of one of the breakable containers of the invention.

Referring to FIGS. 1 and 2, the mixing container of the invention comprises a bucket or container 2 having a closed bottom end 4, an open top end 6, and a lid or cover 10 for closing said top end 6. Located at the outer circumference 12 of said lid 10 are a plurality of tabs 14 which can be fastened to a lip 16 which surrounds the open top end 6 of container 2. By this means and a gasket in lid 10 (not shown), a liquid-tight seal may be achieved between lip 16 and lid 10. A U-shaped handle 18 for assisting in the transport of container 2 is suitably attached to the sides of container 2 as at point 20. In a specific embodiment, container 2 may be a conventional paint bucket especially suited for volumes of one gallon or more.

Located at the center of lid 10 is an aperture 22 covered by a cap 24. Cap 24 is in the form of an inverted deep drawn cup 26 having an open bottom 28 and an aperture 30 in the top of cup 26. An annular flange 32 surrounds open bottom 28 and serves as a mounting flange for cap 24. Cap 24 is mounted to lid 10 so that apertures 22 and 30 are axially aligned. Within the volume of cup 26 is a flexible sealant 34.

A shaft 36 extends axially through apertures 22 and 30. Lower end 38 of shaft 36 is positioned within container 2 and upper end 40 of shaft 36 is positioned outside container 2. Upper end 40 of shaft 36 is threaded as at 41. Perpendicularly secured to the lower end 38 of shaft 36 is an agitator disc 42 comprising a circular piece of sheet metal having a diameter slightly less than the inside diameter of container 2. A plurality of equally spaced-apart apertures 44 are located in agitator disc 42. Also, at the outer circumference 46 of disc 42 are a plurality of oppositely bent tears 48.

Attached to upper end 40 of shaft 36 is a handle 50, which comprises, in a specific embodiment, a rectangularly shaped bar having at the center thereof a threaded hole 52 in which threaded upper end 40 of shaft 36 is positioned.

Located within container 2 is at least one breakable container 54. Breakable container 54 can be made of any relatively durable material which is breakable upon impact with disc 42. In a specific embodiment, container 54 can be made of a plastic film material such as DACRON polyester or the like.

In practice, container 2 is capable of storing two or more incompatible materials. These materials can be mixed within the container prior to use. The larger volume material whether it be a liquid or a powder is positioned within container 2. Each of the other materials are placed within a breakable container 54. Breakable containers 54 are placed within the container 2; with the disc 42, preferably, adjacent the bottom 4 of the container 2 and between the bottom 4 of container 2 and the breakable containers 54. Positioning the disc 42 adjacent the bottom 4 of the container 2 allows a major portion of the shaft 36 to be positioned within the container 2. The lid 10 is then positioned on the lip 16 of the container 2 and a liquid tight seal is made by engaging the tabs 14 of the lid 10 and the lip 16 of the container 2. Handle 50, when the container 2 is used as a shipping container, is removably attached to the upper surface of lid 10.

Prior to use, handle 50 is removed from the lid 10 and threadedly attached to the upper end 41 of shaft 36. The materials within the container 2 may be thoroughly mixed by rotating shaft 36 and at the same time moving disc 42 between its position adjacent the bottom 4 of container 2 to a position adjacent lid 10. By the rotation of disc 42 and the simultaneous movement axially of shaft 36, breakable containers 54 are broken and the contents thereof are thoroughly mixed together and with the material originally placed in container 2. The breakable containers 54 are easily broken by the engagement of the container with the disc 42. Both the apertures 44 and the tears 48 in the disc 42 aid in both breaking of the containers 54 and mixing the contents of container 2. The axial movement of the disc 42 allows the material to pass through the apertures 42 and the tears 48 create good mixing turbulence within the container 2. By this action, a completely homogeneous mixture of all of the materials placed within container 2 and breakable containers 54 can be achieved.

If faster rotation of the disc 42 is desirable, handle 50 can be removed from the threaded end 40 of the shaft 36 and the shaft 36 can be positioned in the chuck of a conventional power drill. The same mixing movement of the disc 42 can be achieved by appropriate motion of the drill.

After mixing, container 2 can be opened by removing said lid 10 by unfastening tabs 14 from lip 16. Removal of lid 10 also results in the removal of shaft 36 and agitator disc 42 from container 2. By unscrewing handle 50 from threaded upper end 40 of shaft 36, lid 10 can be removed from shaft 36 such that shaft 36 and agitator disc 42 can be re-positioned within said container 2 for further mixing of said materials without obstruction from lid 10, if desired.

Figure 3:
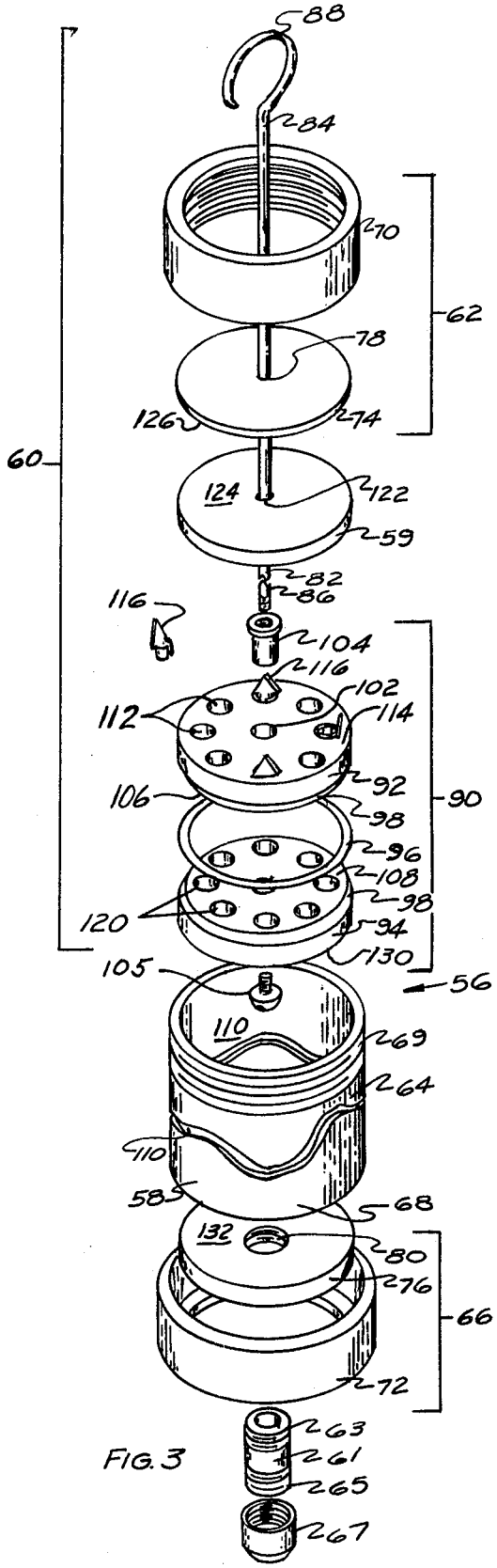
FIG. 3 is a perspective and exploded view of the improved container of the invention, especially useful for quantities smaller than one gallon, and including means by which the mixture therein can be dispensed therefrom.

Referring to FIG. 3, a modified form of the invention is shown which is especially suited for quantities less than one gallon. Illustrated is a container 56 which comprises a tubular shell 58, a foam disc 59, an agitator-plunger 60, and a nozzle 61. In a specific embodiment, nozzle 61 is a metal tube which is threaded at both ends as at 63 and 65.

Shell 58 has an upper cap 62 removably fitted about upper end 64 of shell 58 and a bottom cap 66 fixedly mounted on lower end 68 of shell 58. Upper end 64 may be threaded as at 69 so that cap 62 may be removably secured to shell 58 if desired. Each of the caps 62 and 66 may be integrally formed or comprise a collar as at 70 and 72 and a disc as at 74 and 76. Disc 74 can be positioned within collar 70 and secured therein to form upper cap 62, and similarly, disc 76 can be positioned within collar 72 and secured therein to form bottom cap 66. Each disc has as its center an aperture as at 78 and 80, respectively.

In a specific embodiment, disc 76 may be made of a transparent and rigid sheet of plastic material; shell 58, collars 70 and 72 are made of rigid plastic material and where otherwise not disclosed as being secured in another manner are typically glued together; and aperture 80 is threaded so as to receive end 63 of nozzle 61. The transparency of disc 76 allows for the visual inspection of the mixing operation to be discussed hereinafter.

Agitator-plunger 60 comprises a shaft 82 positioned in aperture 78 and having an end 84 positioned outside container 56 and an end 86 positioned within container 56. Outer end 84 may be bent to form a handle 88. Inner end 86 is connected to agitator-plunger head 90. Agitator-plunger head 90 comprises a top disc 92, a bottom disc 94, and a gasket 96, which in a specific embodiment is an O-ring positioned in groove 98 machined in part in disc 92 and in part in disc 94. Bottom disc 94 is suitably secured to shaft 82 adjacent end 86 and can not rotate independently of shaft 82. Top disc 92 is rotatably mounted to shaft 82 adjacent inner end 86. Disc 92 is parallel to and directly above bottom disc 94. In a specific embodiment, top disc 92 has at its center an aperture 102 in which is journaled a sleeve 104. Sleeve 104 has a threaded interior and is secured to end 86 of said shaft 82 and disc 94 by a conventional screw 105 received in sleeve 104, whereby rotational movement of top disc 92 independent of said shaft 82 bottom disc 94 is accommodated, as will be discussed below.

Assembled, gasket 96 is positioned in groove 98 and the lower surface 106 of top disc 92 and the upper surface 108 of bottom disc 94 are superimposed one on the other. Relative movement between the top disc 92 and the bottom disc 94 is normally prevented by friction therebetween. Gasket 96 has a diameter slightly greater than that of discs 92 and 94 so as to provide a seal between agitator-plunger head 90 and the inner surface 110 of shell 58.

Top disc 92 is made of rigid sheet material having a plurality of apertures 112 in a spaced-apart relationship, as shown in FIG. 3. In the upper surface 114 of said top disc 92, there are a plurality of teeth 116 secured to the inside surface 114 and arranged to extend generally axially of shaft 82 and point upwardly from surface 114. In the specific embodiment illustrated, each tooth 116 has a split-tubular base which is frictionally fit into an aperture 112.

Like top disc 92, bottom disc 94 is made of rigid sheet material having a plurality of apertures 120 in a spaced-apart relationship. The location of apertures 112 in top disc 92 and aperture 120 in disc 94 is identical such that discs 92, 94 when mounted on shaft 82 and superposed on each other can be rotated relative to each other to coaxially position individual apertures 112 and 120.

Foam disc 59 is formed of sheet foam material, disc 59 being made of styrofoam in a specific embodiment. Disc 59 has at its center an aperture 122 in which shaft 82 is coaxially positioned. The diameter of disc 59 is slightly smaller than the inside diameter of shell 58 so that disc 59 may be located inside said shell 58 perpendicular to shaft 82 in parallel spaced-apart relationship with agitator-plunger head 90. Disc 59 is positioned between upper cap 62 and agitator-plunger head 90 and has a thickness sufficient for teeth to be imbedded therein when agitator-plunger head 90 and disc 59 are urged together.

Positioned within shell 58 is at least one breakable container 128. Breakable container 128 can be made of any relatively durable material which is breakable upon impact with teeth 116 of disc 92 or can be pierced by teeth 116 when disc 59 and agitator-plunger head 90 are urged together. In a specific embodiment, container 128 can be made of a plastic sheet material such as DACRON polyester or the like.

In practice, container 56 is capable of storing and completely mixing two or more incompatible materials, and acting as both a shipping and storage container for those materials. The largest volume material is positioned within shell 58; the remaining incompatible materials are each placed within a breakable container 128. Breakable containers 128 are positioned within the shell 58 between the disc 92 and the disc 59. The apertures 112 and 120 in the discs 92 and 94 are aligned when the container 56 is loaded. Disc 94 is preferably positioned adjacent disc 76 thereby positioning a major portion of shaft 82 within container 56.

Prior to use, the mixing of the materials within the container 56 can be achieved by axially moving the agitator-plunger 60 axially of the shaft 82 so as to engage the teeth 116 with the breakable containers 128 and to thereby break or pierce the containers allowing the incompatible components of the mixture to flow together. Repeated upward movement and rotational movement of the agitator-plunger 60 and the imbedding of the teeth 116 in the disc 59 may be necessary in order to break all of the containers 128 in the container 56. Further, it should be noted, that the apertures 112 and 120 respectively in the discs 92 and 94 must be aligned before the agitator-plunger 60 can be axially moved. Preferably, apertures 112 and 120 in discs 92 and 94 are aligned when container 56 is loaded. In the specific embodiment in which the disc 76 is transparent, the alignment of the apertures 112 and 120 can be easily checked, visually, by positioning the agitator-plunger 60 adjacent to disc 76.

Once all of the breakable containers 52 have been broken, complete mixing of the various components of the desired mixture can be accomplished by continuing the axial movement of the agitator-plunger 60 between a position adjacent disc 76 to a position adjacent disc 59. By repeating this movement, the materials within the container 56 are repeatedly forced through the apertures 112 and 120, accomplishing complete and homogeneous mixing of the materials. In a specific embodiment in which disc 76 is transparent, the mixture can be viewed through the disc 76 and if the mixture appears differently than the components thereof, complete and homogeneous mixing can be assured by viewing the mixture from time to time during the mixing operation.

Once the mixture is completely mixed, the container 58 can be used to dispense the mixture from the container out through the nozzle 61. This is achieved by moving the agitator-plunger 60 once again axially of the shaft 82 so as to imbed the teeth 116 in the disc 59. With the teeth 116 embedded in the disc 59, the rotation of the shaft 82 by means of the handle 88 will rotate the disc 94 independently of the disc 92. It is by this means that the apertures 112 and 120 can be both aligned and misaligned, as desired. However, in the case of preparing to dispense the material from the container 58, the apertures 112 and 120 are misaligned thereby converting agitator-plunger 60 into a plunger which is impervious to flow of the mixture through the apertures 112 and 120. The plunger thus becomes a piston. By pushing the agitator-plunger 60 from its position adjacent disc 59 towards disc 76 and removing the cap 67 from the nozzle 61, the mixture within the container 56 will be forced out through the nozzle 61.

The containers 2 and 56 of the invention provide an improved package or shipping container for incompatible materials which are to be used together. Further, both of the containers have self-contained means for mixing the incompatible materials contained therein together prior to use. For some small applications, it is desirable that the container also be a dispenser in which small amounts of the material may be dispensed in a manner similar to those materials normally packaged in tubes which can be squeezed and dispensed therefrom. Caulking materials of all kinds, adhesives, and the like are packaged in such containers. Container 56 possesses all of these desirable characteristics while still providing the self-contained mixing capabilities of the package and shipping containers of the invention.

While there have been described above the principles of this invention in connection with specific apparatus, it is to be clearly understood that this description is made only by way of example and not as a limitation to the scope of the invention.

What is claimed is:

1. A container for storing and mixing two or more incompatible materials, said container comprising an exterior container containing one material having top and bottom ends, at least one interior breakable container containing another material within said exterior container, a rotatable member within said exterior container, means for allowing said rotatable member to be positioned in surface to surface contact with one of said container ends, said rotatable member having thereon means for breaking said interior breakable container, said rotatable member also having thereon means for mixing said material of said breakable container with said material of said exterior container within said exterior container, nozzle means at said bottom end for dispensing said materials from said container, said container having an aperture in said top end, a shaft journaled in said aperture, one of said shaft ends being within said exterior container, said rotatable member including a top member and a bottom member, said bottom member being secured to said one shaft end, said top and bottom members each having a plurality of apertures therein, said breaking means including a plurality of spikes extending from said rotatable member toward said top end, whereby said materials can be essentially completely dispensed from said exterior container, and means engaging said spikes for holding said top member from rotation upon the rotation of said shaft and said bottom member.

2. The device of claim 1 wherein said top member and said bottom member are in a laminar relationship, said top member being journaled about said shaft, said mixing means includes said members having said plurality of apertures therethrough, and further including sealing means for producing a fluid-type seal between said members and said exterior container.

3. The device of claim 2 wherein said sealing means includes a flexible gasket frictionally held between said top and bottom members, said gasket positioned in a channel located in said members.

4. The device of claim 1 wherein each spike is frictionally held within one of said apertures of said top member, whereby said mixture may freely pass through said apertures, said top and bottom members are rotatable up to 360° relative to each other to misalign said apertures, whereby said members become a plunger means for dispensing the mixture out of said nozzle.

5. The device of claim 2 further including means for monitoring the alignment or misalignment of said apertures in said top and bottom members.

6. The device of claim 1 further including means for maintaining said apertures in said top and bottom members in position.

* * * * *